US006629919B2

(12) United States Patent
Egozy et al.

(10) Patent No.: US 6,629,919 B2
(45) Date of Patent: Oct. 7, 2003

(54) CORE FOR BLOOD PROCESSING APPARATUS

(75) Inventors: Yáir Egozy, Sharon, MA (US); Paul J. Vernucci, Billerica, MA (US); Lelie E. Rose, Plainville, MA (US); Etienne Pages, Braintree, MA (US)

(73) Assignee: Haemonetics Corporation, Braintree, MA (US)

( * ) Notice: Subject to any disclaimer, the term of this patent is extended or adjusted under 35 U.S.C. 154(b) by 0 days.

(21) Appl. No.: 09/764,702

(22) Filed: Jan. 18, 2001

(65) Prior Publication Data

US 2001/0027156 A1 Oct. 4, 2001

Related U.S. Application Data

(63) Continuation-in-part of application No. 09/325,253, filed on Jun. 3, 1999, now abandoned.

(51) Int. Cl.[7] ..... B04B 1/04
(52) U.S. Cl. ..... 494/36; 494/37; 494/67
(58) Field of Search ..... 494/10, 36, 37, 494/41, 43, 44, 67, 81; 210/360.1, 380.1, 781, 782

(56) References Cited

U.S. PATENT DOCUMENTS

| | | | | |
|---|---|---|---|---|
| 1,025,059 | A | | 4/1912 | Hatton et al. |
| 1,611,725 | A | * | 12/1926 | Degerth et al. |
| 2,087,778 | A | * | 7/1937 | Nelin |
| 2,750,107 | A | | 6/1956 | More |
| 2,792,172 | A | | 5/1957 | Tait |
| 3,145,713 | A | * | 8/1964 | Latham, Jr. |
| 3,409,213 | A | * | 11/1968 | Latham, Jr. |
| 3,565,330 | A | * | 2/1971 | Latham, Jr. |

FOREIGN PATENT DOCUMENTS

| | | | | |
|---|---|---|---|---|
| EP | 257755 | * | 3/1988 | ..... 494/41 |
| EP | 619145 | * | 10/1994 | ..... 494/41 |
| EP | 664159 | * | 7/1995 | ..... 494/41 |
| EP | 799645 | * | 10/1997 | ..... 494/41 |
| EP | 1057534 | * | 12/2000 | ..... 494/41 |
| JP | 59-6952 | * | 1/1984 | |
| JP | 59-69166 | * | 4/1984 | ..... 494/41 |
| JP | 7-75746 | * | 3/1995 | ..... 494/41 |
| JP | 9-192215 | * | 7/1997 | ..... 494/41 |
| SU | 660718 | * | 5/1979 | ..... 494/41 |
| SU | 762982 | * | 9/1980 | ..... 494/41 |
| SU | 1146098 | * | 3/1985 | ..... 494/41 |
| WO | 90/07383 | * | 7/1990 | ..... 494/41 |
| WO | 94/06535 | * | 3/1994 | |

*Primary Examiner*—Charles E. Cooley
(74) *Attorney, Agent, or Firm*—Bromberg & Sunstein LLP

(57) ABSTRACT

The invention is directed to a centrifugation bowl with a rotating core. The centrifugation bowl includes a rotating bowl body which defines a primary separation chamber. The core, which is generally cylindrically shaped and is disposed within the bowl body, defines a secondary separation chamber. A stationary header assembly may be mounted on top of the bowl body through a rotating seal. The stationary header assembly includes an inlet port for receiving whole blood and an outlet port from which one or more blood components are withdrawn. The inlet port is in fluid communication with a feed tube that extends into the primary separation chamber. The outlet port is in fluid communication with an effluent tube that extends into the bowl body. The effluent tube includes an entryway at a first radial position relative to a central, rotating axis of the bowl. The core is arranged at a second radial position that is outboard from the entryway to the effluent tube and includes one or more core passageways for providing fluid communication between the primary and secondary separation chambers. A sealed region is formed at the upper edge of the core relative to its attachment point to the bowl body. Also provided is a method for recovering a whole blood fraction from a donor using the core of the present invention.

(List continued on next page.)

25 Claims, 11 Drawing Sheets

U.S. PATENT DOCUMENTS

| | | | | |
|---|---|---|---|---|
| 3,655,058 | A | | 4/1972 | Novak |
| 3,774,840 | A | | 11/1973 | Boatright |
| 4,014,497 | A | | 3/1977 | Spiewok et al. |
| 4,040,965 | A | | 8/1977 | Kohlheb |
| 4,086,924 | A | | 5/1978 | Latham, Jr. |
| 4,140,268 | A | * | 2/1979 | Lacour |
| 4,300,717 | A | * | 11/1981 | Latham, Jr. |
| 4,425,114 | A | | 1/1984 | Schoendorfer et al. |
| 4,466,888 | A | | 8/1984 | Verkaart |
| 4,534,863 | A | | 8/1985 | Bacon et al. |
| 4,684,361 | A | * | 8/1987 | Feldman et al. |
| 4,692,136 | A | * | 9/1987 | Feldman et al. |
| 4,713,176 | A | | 12/1987 | Schoendorfer et al. |
| 4,740,202 | A | | 4/1988 | Stacey et al. |
| 4,740,313 | A | | 4/1988 | Schoendorfer et al. |
| 4,755,300 | A | | 7/1988 | Fischel et al. |
| 4,767,396 | A | * | 8/1988 | Powers |
| 4,795,419 | A | * | 1/1989 | Yawn et al. |
| 4,795,448 | A | | 1/1989 | Stacey et al. |
| 4,806,247 | A | | 2/1989 | Schoendorfer et al. |
| 4,808,307 | A | | 2/1989 | Fischel et al. |
| 4,869,812 | A | | 9/1989 | Schoendorfer et al. |
| 4,871,462 | A | | 10/1989 | Fischel et al. |
| 4,876,013 | A | | 10/1989 | Shmidt et al. |
| 4,889,524 | A | | 12/1989 | Fell et al. |
| 4,943,273 | A | | 7/1990 | Pages |
| 4,983,158 | A | | 1/1991 | Headley |
| 4,994,188 | A | | 2/1991 | Prince |
| 5,045,048 | A | * | 9/1991 | Kaleskas et al. |
| 5,100,372 | A | | 3/1992 | Headley |
| 5,100,564 | A | | 3/1992 | Pall et al. |
| 5,194,145 | A | | 3/1993 | Schoendorfer |
| 5,254,248 | A | | 10/1993 | Nakamura |
| 5,387,174 | A | * | 2/1995 | Rochat |
| 5,403,272 | A | | 4/1995 | Deniega et al. |
| 5,405,308 | A | | 4/1995 | Headley et al. |
| 5,431,814 | A | * | 7/1995 | Jorgensen |
| 5,462,667 | A | * | 10/1995 | Wollinsky et al. |
| 5,494,592 | A | | 2/1996 | Latham, Jr. et al. |
| 5,514,070 | A | | 5/1996 | Pages |
| 5,551,941 | A | * | 9/1996 | Howell |
| 5,585,007 | A | * | 12/1996 | Antanavich et al. |
| 5,607,579 | A | | 3/1997 | Latham, Jr. et al. |
| 5,649,903 | A | | 7/1997 | Deniega et al. |
| 5,656,163 | A | | 8/1997 | Brown |
| 5,733,446 | A | | 3/1998 | Holm |
| 5,738,792 | A | | 4/1998 | Schoendorfer |
| 5,762,791 | A | | 6/1998 | Deniega et al. |
| 5,783,085 | A | | 7/1998 | Fischel |
| 5,792,351 | A | | 8/1998 | Wehrle et al. |
| 5,882,289 | A | * | 3/1999 | Sakota et al. |
| 5,919,125 | A | * | 7/1999 | Berch |
| 6,464,624 | B2 | * | 10/2002 | Pages |

* cited by examiner

CORE FOR BLOOD PROCESSING APPARATUS

CROSS-REFERENCE TO RELATED APPLICATION

This application is a continuation-in-part of U.S. patent application Ser. No. 09/325,253, filed on Jun. 3, 1999, and titled CENTRIFUGATION BOWL WITH ROTATING FILTER CORE, abandoned, the entire disclosure of which is incorporated herein by reference.

BACKGROUND OF THE INVENTION

1. Field of the Invention

The invention relates to centrifugation bowls for separating blood and other biological fluids. More specifically, the present invention relates to a centrifugation bowl having an improved core that aids in separating and harvesting individual blood components from whole blood.

2. Background Information

Human blood predominantly includes three types of specialized cells (i.e., red blood cells, white blood cells, and platelets) that are suspended in a complex aqueous solution of proteins and other chemicals called plasma. Although in the past blood transfusions have used whole blood, the current trend is to collect and transfuse only those blood components or fractions required by a particular patient. This approach preserves the available blood supply and in many cases is better for the patient, since the patient is not exposed unnecessarily to other blood components and the risks of infection or adverse reaction that may be attendant with those other components. Among the more common blood fractions used in transfusions, for example, are red blood cells and plasma. Plasma transfusions, in particular, are often used to replenish depleted coagulation factors. Indeed, in the United States alone, approximately two million plasma units are transfused each year. Collected plasma is also pooled for fractionation into its constituent components, including proteins, such as Factor VIII, albumin, immune serum globulin, etc.

One method of separating whole blood into its various constituent fractions, including plasma, is "bag" centrifugation. According to this process, one or more units of anticoagulated whole blood are pooled into a bag. The bag is then inserted into a lab centrifuge and spun at very high speed, subjecting the blood to many times the force of gravity. This causes the various blood components to separate into layers according to their densities. In particular, the more dense components, such as red blood cells, separate from the less dense components, such as white blood cells and plasma. Each of the blood components may then be expressed from the bag and individually collected.

Another separation method is known as bowl centrifugation. U.S. Pat. No. 4,983,158 issued Jan. 8, 1991 to Headley ("the '158 patent") discloses a centrifuge bowl having a seamless bowl body and an inner core including four peripheral slots located at the top of the core. The centrifuge bowl is inserted in a chuck which rotates the bowl at high speed. Centrifugation utilizing this device is accomplish by withdrawing whole blood from a donor, mixing it with anticoagulant and pumping it into the rotating centrifuge bowl. The more dense red blood cells are forced radially outward from the bowl's central axis and collected along the inner wall of the bowl. The less dense plasma is displaced inwardly toward the core and allowed to escape through the slots. The plasma is forced through an outlet of the bowl and is separately collected.

The centrifugation bowl of the '158 patent can also be used to perform apheresis. Apheresis is a process in which whole blood is withdrawn from a donor and separated and the blood components of interest are collected while the other blood components are retransfused into the donor. By returning some blood components to the donor (e.g., red blood cells), greater quantities of other components (e.g., plasma) can generally be collected.

Despite the centrifugation system's generally high separation efficiency, the collected plasma can nonetheless contain some residual blood cells. For example, in a disposable harness utilizing a blow-molded centrifuge bowl, the collected plasma typically contains from 0.1 to 30 white blood cells and from 5,000 to 50,000 platelets per need to keep the bowl's filling rate in excess of 60 milliliters per minute (ml/min.) to minimize the collection time, thereby causing slight re-mixing of blood components within the bowl.

Another method of separating whole blood into its individual components is membrane filtration. Membrane filtration processes typically incorporate either internal or external filter media. U.S. Pat. No. 4,871,462 issued to Baxter ("the '462 patent") provides one example of a membrane filtration system using an internal filter. The device of the '462 patent includes a filter having a stationary cylindrical container that houses a rotatable, cylindrical filter membrane. The container and the membrane cooperate to define a narrow gap between the side wall of the container and the filter membrane. Whole blood is introduced into this narrow gap during apheresis. Rotation of the inner filter membrane at sufficient speed generates so-called Taylor vortices in the fluid. The presence of Taylor vortices basically causes shear forces that drive plasma through the membrane, while sweeping red blood cells away.

The prior art membrane filtration devices can often produce a purer blood product, i.e., a blood fraction (e.g., plasma) having fewer residual cells (e.g., white blood cells). However, they typically comprise many intricate components some of which can be relatively costly, making them complicated to manufacture and expensive to produce. Prior art centrifugation devices, conversely, are typically less expensive to produce because they are often simpler in design and require fewer parts and/or materials. Such devices, however, may not produce blood components having the same purity characteristics as membrane filtration devices.

Centrifugation and membrane filtration can also be combined into a single blood processing system. FIG. 1, for example, illustrates a bowl centrifugation system 100 that also includes an external filter medium 142. The system 100 includes a disposable harness 102 that is loaded onto a blood processing machine 104. The harness 102 includes a phlebotomy needle 106 for withdrawing blood from a donor's arm 108, a container of anti-coagulant solution 110, a temporary red blood cell (RBC) storage bag 112, a centrifugation bowl 114, a primary plasma collection bag 116 and a final plasma collection bag 118. An inlet line 120 couples the phlebotomy needle 106 to an inlet port 122 of the bowl 114, and an outlet line 124 couples an outlet port 126 of the bowl 114 to the primary plasma collection bag 116. A filter 142 is disposed in a secondary outlet line 144 that couples the primary and final plasma collection bags 116, 118 together. The blood processing machine 104 includes a controller 130, a motor 132, a centrifuge chuck 134, and two peristaltic pumps 136 and 138. The controller 130 is operably coupled to the two pumps 136 and 138 and to the motor 132 which, in turn, drives the chuck 134.

In operation, the inlet line 120 is fed through the first peristaltic pump 136 and a feed line 140 from the anticoagulant 110, which is coupled to the inlet line 120, is fed through the second peristaltic pump 138. The centrifugation bowl 114 is also inserted into the chuck 134. The phlebotomy needle 106 is then inserted into the donor's arm 108 and the controller 130 activates the two peristaltic pumps 136, 138, thereby mixing anticoagulant with whole blood from the donor, and transporting anti-coagulated whole blood through inlet line 120 and into the centrifugation bowl 114. Controller 130 also activates the motor 132 to rotate the bowl 114 via the chuck 134 at high speed. Rotation of the bowl 114 causes the whole blood to separate into discrete layers by density. In particular, the denser red blood cells accumulate at the periphery of the bowl 114 while the less dense plasma forms an annular ring-shaped layer inside of the red blood cells. The plasma is then forced through an effluent port (not shown) of the bowl 114 and is discharged from the bowl's outlet port 126. From here, the plasma is transported by the outlet line 124 to the primary plasma collection bag 116.

When all the plasma has been removed and the bowl 114 is full of RBCs, it is typically stopped and the first pump 136 is reversed to transport the RBCs from the bowl 114 to the temporary RBC collection bag 112. Once the bowl 114 is emptied, the collection and separation of whole blood from the donor is resumed. At the end of the process, the RBCs in the bowl 114 and in the temporary RBC collection bag 112 are returned to the donor through the phlebotomy needle 106. The primary plasma collection bag 116, which is now full of plasma, is then processed. In particular, a valve (not shown) is opened allowing plasma to flow through the secondary outlet line 144, the filter 142, and into the final plasma collection bag 118.

Although the combined system of FIG. 1 may produce a purer blood product as compared to conventional centrifugation, it is far more expensive to manufacture.

SUMMARY OF THE INVENTION

Briefly, the present invention is directed to a centrifugation bowl with a rotating core having a novel configuration. The centrifugation bowl includes a rotating bowl body which defines a primary separation chamber. A stationary header assembly is mounted on top of the bowl body through a rotating seal. The stationary header assembly includes an inlet port for receiving whole blood and an outlet port from which one or more blood components are withdrawn. The inlet port is in fluid communication with a feed tube that extends into the primary separation chamber. The outlet port is in fluid communication with an effluent tube that extends into the bowl body. The effluent tube includes an entryway at a first radial position relative to a central, rotating axis of the bowl. The core, which is generally cylindrically shaped, is also disposed within the bowl body and defines a secondary separation chamber therein. The core or at least a portion thereof is arranged at a second radial position that is outboard from the entryway to the effluent tube and includes one or more passageways for providing fluid communication between the primary and secondary separation chambers.

In accordance with the present invention, the core has a sealed region at its upper edge relative to both the header assembly and the core's attachment point to the bowl. The sealed region is free of any perforations, slots or holes and extends a substantial axial length of the core, e.g., one-quarter or more of the core's length. Adjacent to the sealed region is a fluid transfer region, which may extend the remaining length of the core, e.g., three-quarters of the core's length. The one or more passageways, which in the preferred embodiment are circular holes, are located in the fluid transfer region of the core. By incorporating an the upper solid region, which is free of any perforations, slots or holes, the upper most passageway through the core is distally positioned relative to the header assembly and the core's attachment point.

In operation, the bowl is rotated by a centrifuge chuck. Anti-coagulated whole blood is delivered to the inlet port and flows through the feed tube into the bowl body. The centrifugal forces generated within the separation chamber by rotation of the bowl cause the whole blood to separate into its discrete components in the primary separation chamber. In particular, denser red blood cells form a first layer against the periphery of the bowl body and the remaining components, consisting essentially of plasma, which is less dense than red blood cells, form an annular-shaped second layer inside of the red blood cell layer. As more whole blood is delivered to the bowl body, the annular-shaped plasma layer closes in on and eventually contacts the core. The plasma layer, including some non-plasma blood components, passes through the passageways in the transfer region of the core and enters the secondary separation chamber.

Within the secondary separation chamber, the same centrifugal forces generated by rotation of the bowl induce further separation of the plasma component from the non-plasma blood components within the core. The plasma separated within the secondary chamber is driven toward the entryway of the effluent tube where it is withdrawn from the bowl. The combination of the sealed and transfer regions of the core help establish a more uniform flow pattern, thereby facilitating further separation of the plasma within the secondary separation chamber. Non-plasma components that entered the secondary separation chamber are preferably kept away from the effluent tube, and may even be forced back into the primary separation chamber through additional passageways in the transfer region of the core. To collect additional blood components beside plasma, rotation of the bowl is continued, thereby permitting platelets, white blood cells and/or red blood cells to be harvested as well.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
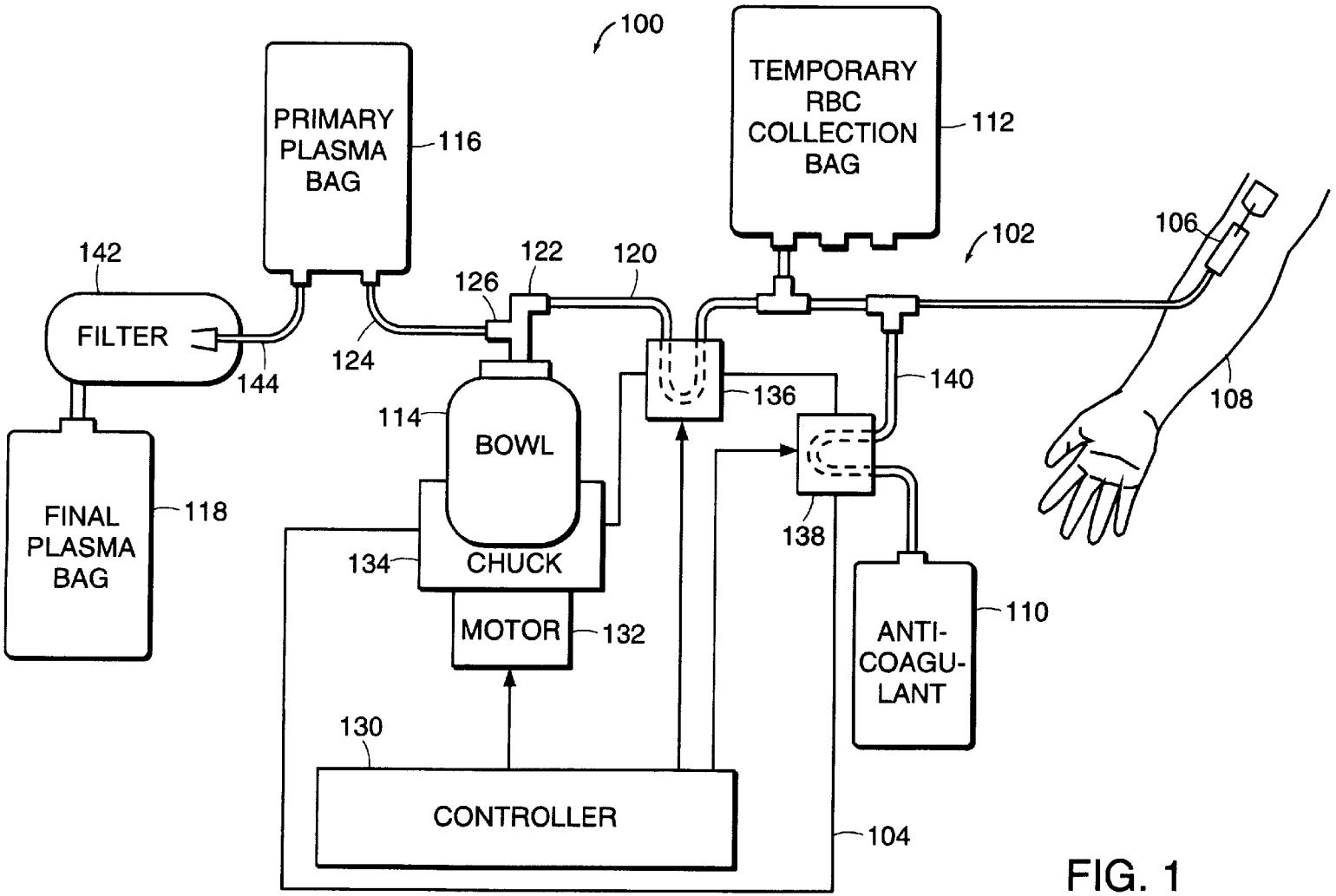
FIG. 1 PRIOR ART
FIG. 1, previously discussed, is a block diagram of a plasmapherisis system.
Figure 2:
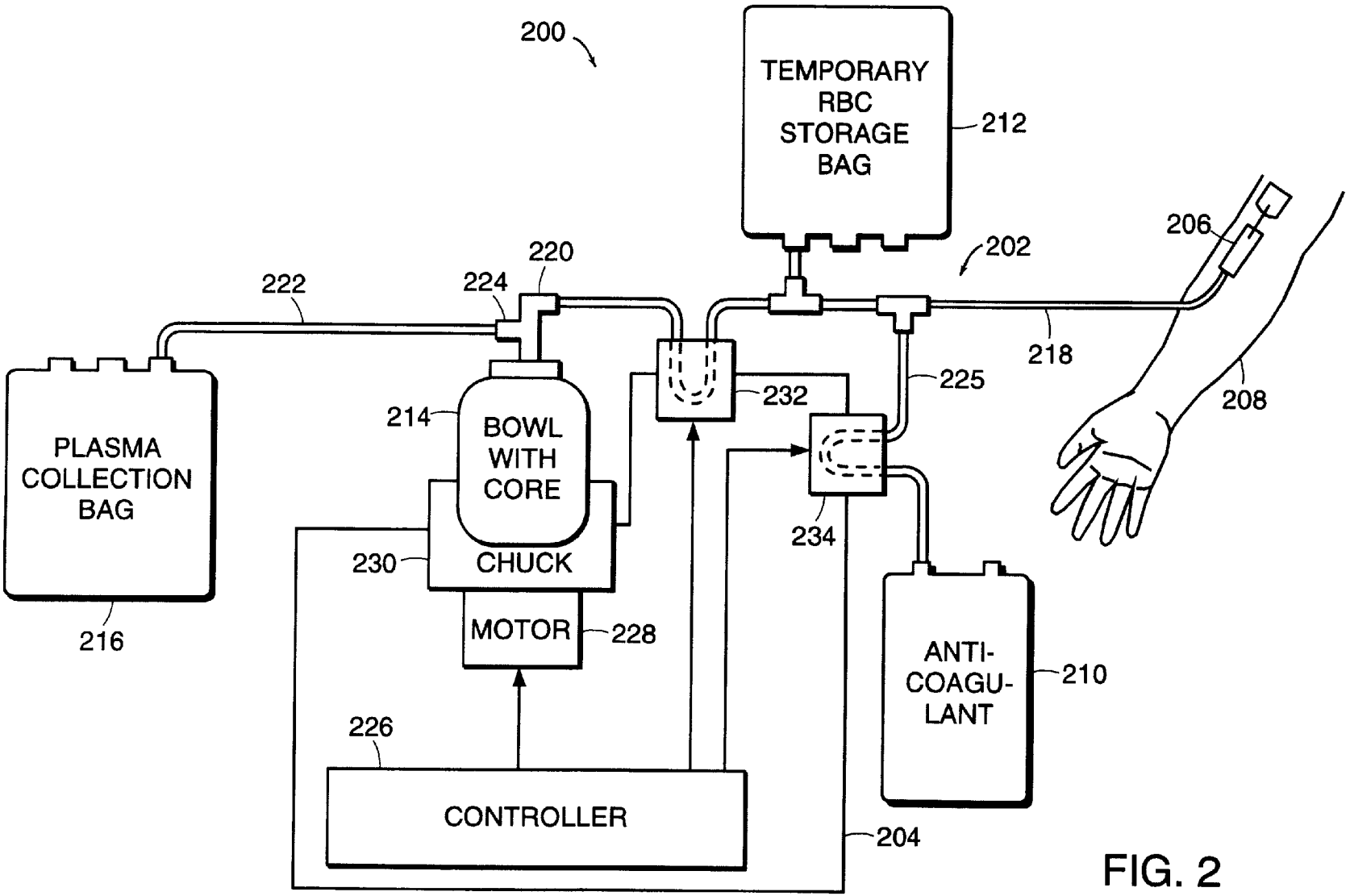
FIG. 2 is a block diagram of a blood processing system in accordance with the present invention.

FIG. 2 is a schematic block diagram of a blood processing system 200 in accordance with the present invention. System 200 includes a disposable collection set 202 that may be loaded onto a blood processing machine 204. The collection set 202 includes a phlebotomy needle 206 for withdrawing blood from a donor's arm 208, a container of anti-coagulant 210, such as AS-3, which is made by MedSep, a division of Pall Corporation, a temporary red blood cell (RBC) storage bag 212 (which is optional depending on the blood component being collected and the number of cycles being performed), a centrifugation bowl 214 and a final plasma collection bag 216. An inlet line 218 couples the phlebotomy needle 206 to an inlet port 220 of the bowl 214, and an outlet line 222 couples an outlet port 224 of the bowl 214 to the plasma collection bag 216. A feed line 225 connects the anti-coagulant 210 to the inlet line 218. The blood processing machine 204 includes a controller 226, a motor 228, a centrifuge chuck 230, and two peristaltic pumps 232 and 234. The controller 226 is operably coupled to the two pumps 232 and 234, and to the motor 228, which, in turn, drives the chuck 230.

One example of a suitable blood processing machine for use with the present invention is the PCS®2 System which is commercially available from Haemonetics Corporation of Braintree, Mass. This device is used to collect plasma.

Configuration of the Centrifuge Bowl of the Present Invention

Figure 3:
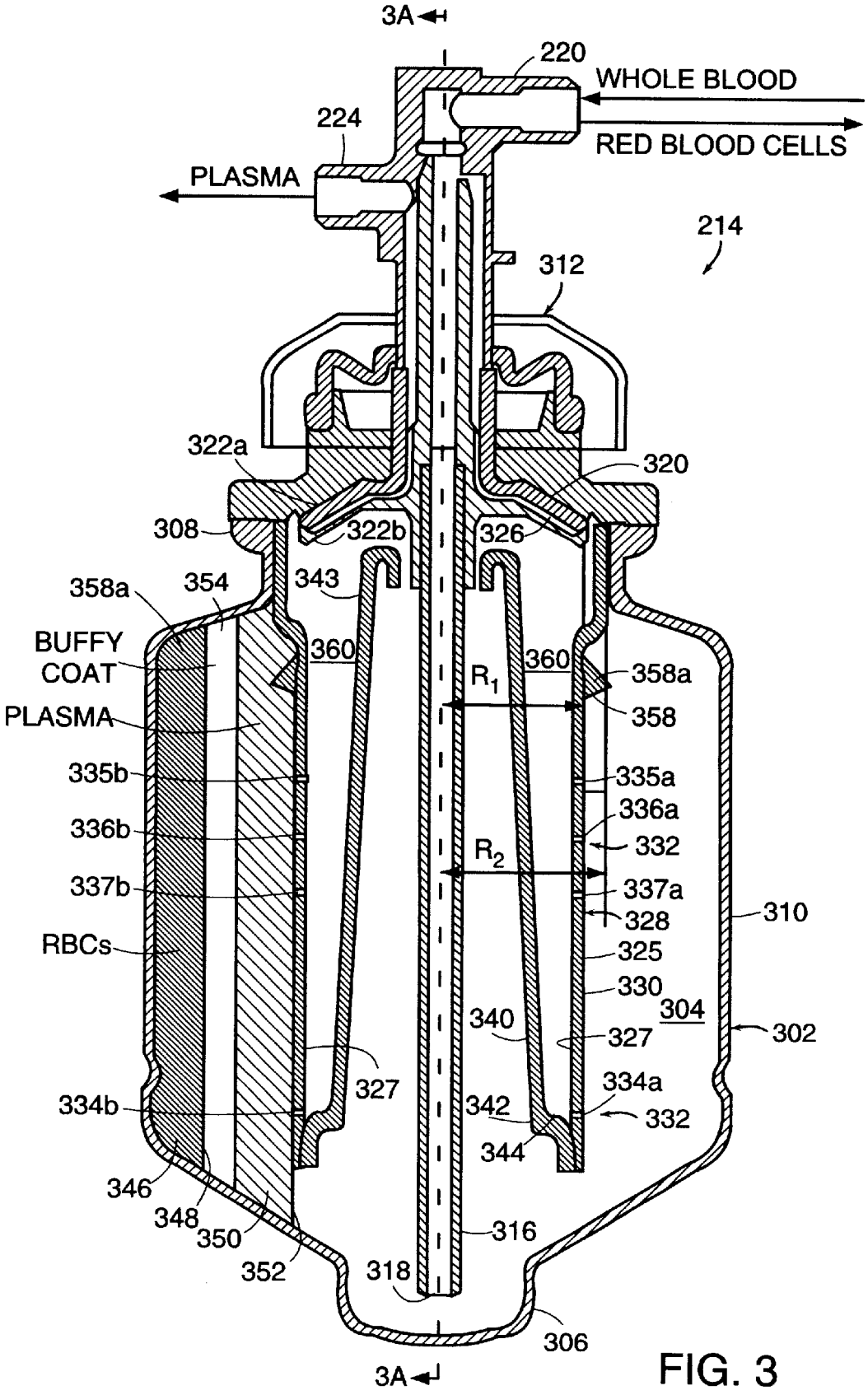
FIG. 3 is a cross-sectional side view of the centrifugation bowl of FIG. 2, illustrating a preferred embodiment of the core of the present invention.

FIG. 3 is a cross-sectional side view of the centrifugation bowl 214 of the present invention. Bowl 214 includes a generally cylindrical bowl body 302 which defines an enclosed primary separation chamber 304. The bowl body 302 includes a base 306, an open top 308 and a side wall 310. The bowl 214 further includes a header or cap assembly 312 that is mounted to the top 308 of the bowl body 302 by a ring-shaped rotating seal. The header assembly 312 includes an inlet port 220 and an outlet port 224. Extending from the header assembly 312 into the separation chamber 304 is a feed tube 316 that is in fluid communication with inlet port 220. The feed tube 316 has an opening 318 that, when the header is mounted to the bowl body, is preferably positioned proximate to the base 306 of the bowl body 302 so that liquid flowing through the feed tube 316 is discharged at the base 306 of the bowl body 302. The header assembly 312 also includes an outlet, such as an effluent tube 320, that is disposed within the bowl 214. The effluent tube 320 may be positioned proximate to the top 308 of the bowl body 302. In the preferred embodiment, the effluent tube 320 is formed from a pair of spaced-apart disks 322*a*, 322*b* that define a passageway 324 whose generally circumferential entryway 326 is located at a first radial position, $R_1$, relative to a central axis of rotation A—A of the bowl 214.

A suitable header assembly and bowl body for use with the present invention are described in U.S. Pat. No. 4,983,158 to Headley (the "'158") patent, which is hereby incorporated by reference in its entirety. Nonetheless, it should be understood that other bowl configurations may be advantageously utilized with the present.

Disposed within the bowl body 302 is a core 328 having a generally cylindrical outer wall 330 having an outer surface 325 and an inner surface 327 relative to axis A—A. Outer wall 330, or at least a portion thereof is preferably disposed at a second radial position, $R_2$, that is slightly outboard of the first radial position, $R_1$, which, as described above, defines the location of the entryway 326 to the passageway 324. Core 328 may, but need not, include an inner wall 340 that can be joined to the inner surface 327 of outer wall 330 either directly or via a skirt 342. Inner wall 340, which includes first and second ends 343, 344 that are open to receive feed tube 316, can be conical in configuration and may be in the form of a truncated cone. As described in more detail below, the core 328 defines a secondary separation chamber 360 located inboard of outer wall 330 relative to axis A—A. Secondary separation chamber 360 may be bounded by the outer wall 330, skirt 342 and inner wall 340.

Figure 3A:
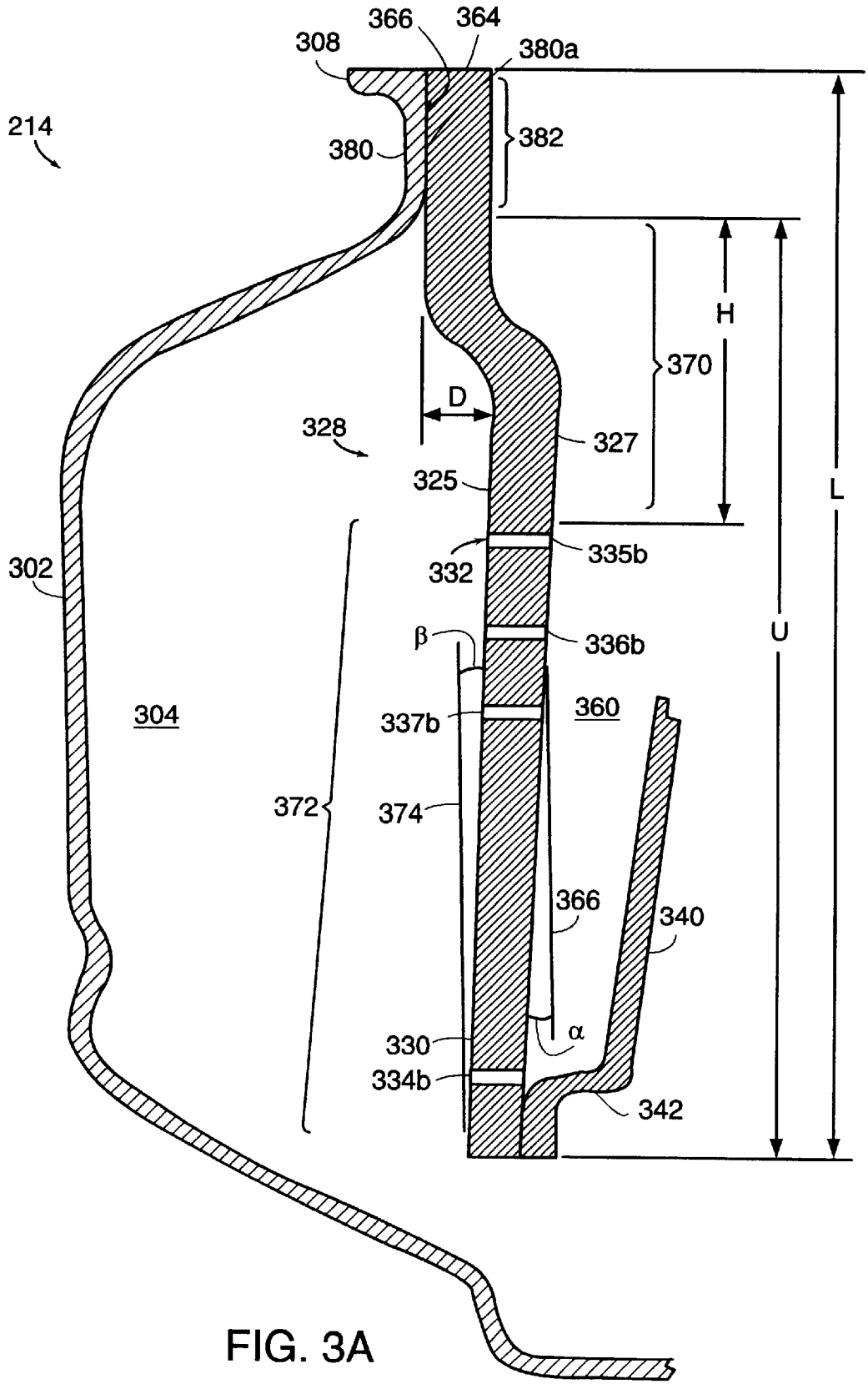
FIG. 3A is an expanded, partial view of the bowl of FIG. 3.

FIG. 3A is an enlarged, partial view of the bowl and core of FIG. 3. As shown, the bowl top 308 defines an opening 366 into which the core 328 is received during assembly of the bowl 214. The bowl top 308 may further define a neck portion 380 that extends at least partially in the axial direction and defines an inner surface 380*a*. An upper portion 382 of the core 328 matingly engages the inner surface 380*a* of the bowl neck 380 so as to provide a fluid seal therebetween. That is, core upper portion 382 may be bonded to the inner surface 380*a* of the neck 380. Alternatively or additionally, the core upper portion 382 may threadably engage the inner surface 380*a* of the neck 380. As a result, core 328 has an overall axial length "L" and a useful axial length "U" which is defined as that part of the core 328 that extends into the primary separation chamber 304. The useful length "U" basically equals the overall length "L" minus the axial length of the bowl neck 380.

In a preferred embodiment, the core's useful length "U" extends along a substantial axial length (e.g., 50% or more) of the bowl body 302. The core 328 is preferably symmetrical about the axis of rotation. In other words, the axis of the generally cylindrical core 328 is aligned with the axis of rotation A—A, when the core 328 is inserted into the bowl body 302. The core 328 has a top portion 364, which, when inserted in the bowl body 302, may be proximate to the open top 308 of the bowl body 302. In accordance with the present invention, outer wall 330 includes a sealed region 370 and a fluid transfer region 372. The sealed region 370 is located at an upper portion of the core 328 relative to the core top 364. The sealed region 370 is free of any perforations, passageways or holes. Disposed within the fluid transfer region 372 of the core 328 is at least one core passageway generally designated 332 which extends through the outer wall 330. Passageway 332 permits fluid communication between the primary separation chamber 304 and the secondary chamber 360. From the secondary chamber 360, moreover, fluid can flow to the effluent tube 320 (FIG. 3), and thus be removed from the bowl 214 via the outlet 224 of header assembly 312.

The sealed region 370 of the core 328 preferably extends a significant axial length "H" of the core 328. More specifically, the axial length "H" of the sealed region 370 is greater than approximately 15% of the core's useful length "U". Preferably, "H" is approximately 15–60% of the core's useful length "U", and more preferably, is approximately 25–33%. The fluid transfer region 372 makes up the remaining length "U" of the core 328. In other words, the length of fluid transfer region 372 is U–H. For a core 328 having a useful axial length "U" of approximately 75 millimeters (mm), the length "H" of the sealed region 370 is preferably in the range of approximately 1145 mm. In the preferred embodiment, the length "H" is approximately 20 mm.

In the preferred embodiment, there are multiple passageways formed along the transfer region 372 of the outer wall 330 of core 328, including at least one (and preferably two) lower core hole(s) 334*a*, 334*b* (FIG. 3) relative to the bowl base 306 on opposing sides of the outer wall 330, and at least one (and preferably six) upper core hole(s) 335*a–b*, 336*a–b*, 337*a–b* relative to the bowl top 308 which are also generally formed on opposing sides of the outer wall 330. While FIG. 3 illustrates upper core holes 335, 336 and 337 that are equally spaced apart axially along outer wall 330, it will be recognized that the axial and circumferential spacing of the upper core holes 335, 336 and 337 relative to each other is not critical. Since the sealed region 370 is free of any perforations, passageways or holes, the uppermost passageway(s) 325*a–b* in the core 328 relative to the bowl top 308 is distally spaced-from the bowl top 308 and/or the header assembly 312.

In addition, at least some of the core's passageways, e.g., uppermost passageways 325*a–b* are also preferably spaced inwardly a radial distance "D" relative to the opening 366 in the bowl top 308. For an opening 366 of 49 mm in diameter, the distance "D" is preferably in the range of approximately of 0–25 mm or is 0–63% of the opening 366 in the bowl body 302. In the preferred embodiment, the distance "D" is approximately 0.5–15 mm or 1.3–31%, and more preferably is approximately 3.3 mm or 8% of the core's diameter.

Core passageway configurations adaptable within the scope of the present invention include slots and/or circular holes. Where the core passageway 332 is a slot, the size of the slot may be varied. A slot, for example, may measure axially between 1–64 mm in length. Where the core passageway 332 is a circular hole, its diameter may measure between 0.25–10 mm. In the preferred embodiment, core passageway 332 is a hole which measures approximately between 0.5–4 mm in diameter, and more preferably, is 1.0 mm in diameter.

In addition to the incorporation of a sealed region 370, the inner surface 327 of the outer wall 330 is preferably sloped along the axial direction, rather than being parallel to the axis of rotation. More specifically, the slope of inner surface 327 can be defined by an angle $\alpha$ which extends from a line 366, that is parallel to the axis of rotation A—A, to the inner surface 327 of the outer wall 330. The slope angle $\alpha$ of inner surface 327 may range between approximately +10 and −10 degrees, i.e., surface may have a reverse slope. In the preferred embodiment, a is between +2 and −2 degrees, and more preferably is approximately 1.0 degrees. The outer surface 325 of the outer wall 330 may also be sloped relative to the axis of rotation. The slope of outer surface 325 can be defined by an angle $\beta$ which extends from a line 374, that is parallel to the axis of rotation A—A, to the outer surface 325 of the outer wall 330. The slope angle $\beta$ of outer surface 325 may range between approximately 0–15 degrees. In the preferred embodiment, there is no slope on outer surface 325.

For an outer wall 330 having a uniform thickness, sloping the inner surface 327 also results in the same slope being imposed on the outer surface 325. Alternatively, the outer wall 330 may taper in thickness such that outer surface 325 remains parallel to the axis or rotation, while the inner surface 327 is sloped. The outer wall 330 may also taper in thickness in such a way that both the inner surface 327 and the outer surface 325 are sloped relative to the axis of rotation A—A.

The inner wall 340 maybe slightly shorter in length relative to the outer wall 330, and may be of a uniform thickness. Where an inner wall 340 is provided, the lower core holes 334*a–b* are formed on the outer wall 330 such that they provide fluid communication from the primary separation chamber 304 into the secondary separation chamber 360 proximate to the skirt 342. Core 328 is preferably formed from a biocompatible material, such as high-impact polystyrene or polyvinyl chloride (PVC), and has a generally smooth surface.

Operation of the Present Invention

The following discussion describes the operation of the present invention to harvest plasma from a whole blood sample. It will be recognized, however, that plasma is but one blood fraction that may be separated from whole blood using the centrifugal bowl and core of the present invention. Platelets and white blood cells may also be harvested in the manner described simply by continuing operation of the centrifuge after the plasma fraction is removed. Given the relative densities of these blood fractions, it will also be recognized that platelets will first be removed by continued operation of the present invention, followed thereafter by white blood cells. It will also be recognized that the present invention provides a purer red blood cell fraction than other centrifugation devices heretofore known in the art as the red blood cells remaining in the primary separation chamber following removal of the other whole blood components will contain fewer residual whole blood elements. Accordingly, while the following discussion elaborates on the operation of the present invention, it in no way delimits the utility of the present invention to collecting only plasma from whole blood.

In operation, the disposable collection set 202 (FIG. 2) is loaded onto the blood processing machine 204. In particular, the inlet line 218 is routed through the first pump 232 and the feed line 225 from the anti-coagulant container 210 is routed through the second pump 234. The centrifugation bowl 214 is securely loaded into the chuck 230, with the header assembly 312 held stationary. The phlebotomy needle 206 is then inserted into the donor's arm 208. Next, the controller 226 activates the two pumps 232, 234 and the motor 228. Operation of the two pumps 232, 234 causes whole blood from the donor to be mixed with anti-coagulant from container 210 and delivered to the inlet port 220 of the bowl 214. Operation of the motor 228 drives the chuck 230, which, in turn, rotates the bowl 214. The anti-coagulated whole blood flows through the feed tube 316 (FIG. 3) and enters the primary separation chamber 304.

Centrifugal forces generated within the rotating bowl 214 push the blood against side wall 310 of the primary separation chamber 304. Continued rotation of the bowl 214 causes the blood in the primary separation chamber 304 to separate into discrete layers by density. In particular, RBCs which are the densest component of whole blood form a first layer 346 against the periphery of side wall 310. The RBC layer 346 has a surface 348. Inboard of the RBC layer 346 relative to axis A—A, a layer 350 of plasma forms, since plasma is less dense than red blood cells. The plasma layer 350 also has a surface 352. A buffy coat layer 354 containing white blood cells and platelets may also form between the layers of red blood cells and plasma 346, 350.

As additional anti-coagulated whole blood is delivered to the primary separation chamber 304 of the bowl 214, each layer 346, 350 and 354 "grows" and the surface 352 of the plasma layer 350 moves toward the central axis A—A. When sufficient whole blood has been introduced into the primary separation chamber 304, the surface 352 of the plasma layer 350 contacts the cylindrical outer wall 330 of the core 328 and enters the secondary separation chamber 360 by passing through core passageway 332 (i.e., core holes 334–337).

Figure 4:
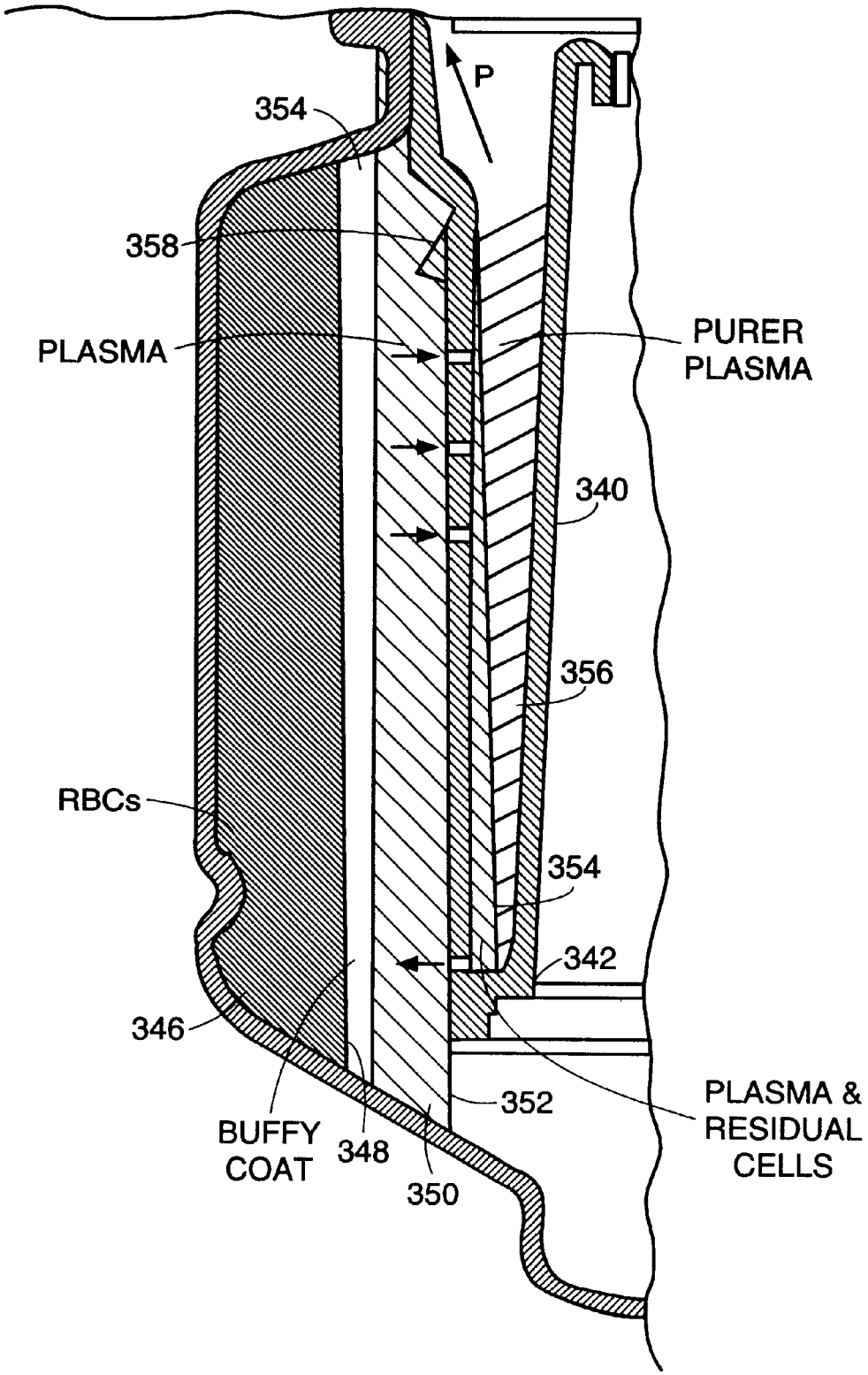
FIG. 4 is a partial-sectional side view of the centrifugation bowl taken at lines 4—4 of FIG. 3.

The plasma which enters the secondary separation chamber 360 may include residual blood components, such as white blood cells and platelets, notwithstanding the configuration of the passageways 332. Once inside the secondary separation chamber 360, however, the plasma 354 undergoes a secondary separation process due to continued rotation of the bowl 214 and core 328, and forms a second plasma layer 356 (FIG. 4). This second plasma layer 354 is further purified of the non-plasma components that may have entered the secondary separation chamber 360 via passageways 332 in the same manner as the separation process that occurs in the primary separation chamber 304. That is, the same centrifugal forces generated by rotation of the bowl 214 and core 328 which push the denser blood components away from the axis of rotation A—A and toward bowl wall 310 force the non-plasma components in the second plasma layer 356 away from the axis of rotation A—A and against the sloped inner surface 327 of outer wall 330.

As illustrated in FIG. 4, the combined influence of the forces generated by rotation of the bowl 214 and core 328, and the downward slope of the inner surface 327 of the outer wall 330 cause residual non-plasma components 354 to move toward the skirt 342 and away from effluent tube 320, and permit the purer second plasma layer 356 to be formed within the secondary separation chamber 360. The non-plasma components may even exit the secondary separation chamber 360 via lower core holes 334*a–b* and return to the primary separation chamber 304. At the same time that non-plasma components 354 are forced out of the secondary separation chamber 360, the purer plasma of layer 356 "climbs" up the sloped inner surface 327 of the outer wall 330 until a sufficient pressure head is generated to "push" the plasma into entryway 326 of the effluent tube 320 as shown by arrow P (FIG. 4). From here, the plasma is removed from the bowl 214 through the outlet port 224 and is carried through the outlet line 222 (FIG. 2) and into the plasma collection bag 216.

As additional anti-coagulated whole blood is delivered to the bowl 214 and separated plasma removed, the depth of the RBC layer 346 will grow. When the surface 348 of the RBC layer 346 reaches the core 328, indicating that all of the plasma in the primary separation chamber 304 has been removed, the process is preferably suspended.

The fact that the surface 348 of the RBC layer 346 has reached the core 328 may be optically detected. In particular, the outer wall 330 of core 328 may include one or more optical reflectors 358 (FIG. 3), which can extend around the entire circumference of the core 328. The reflector 358 may be generally triangular in cross-section and define a reflection surface 358*a*. The reflector 358 cooperates with an optical emitter and detector (not shown) located in the blood processing machine 204 to sense the presence of the RBCs at a pre-selected point relative to the core 328 causing a corresponding signal to be sent to the controller 226. In response, the controller 226 suspends the process.

It should be understood that the optical components and the controller 226 may be configured to suspend bowl filling at alternative conditions and/or upon detection of other blood fractions.

Specifically, the controller 226 de-activates the pumps 232, 234 and the motor 228, thereby stopping the bowl 214. Without the centrifugal forces, the RBCs in layer 346 drop to the bottom of the bowl 214. That is, the RBCs settle to the bottom of the primary separation chamber 304 opposite the header assembly 312 and any non-plasma components 354 in the secondary separation chamber 360 drain out of the secondary chamber 360 and into the bowl body 304 through lower core holes 334.

After waiting a sufficient time for the RBCs to settle in the stopped bowl 214, the controller 226 activates pump 232 in the reverse direction. This causes the RBCs in the lower portion of the bowl 214 to be drawn up the feed tube 316 and out of the bowl 214 through the inlet port 220. The RBCs are then transported through the inlet line 218 and into the temporary RBC storage bag 212. It should be understood that one or more valves (not shown) may be operated to ensure that the RBCs are transported to bag 212. To facilitate the evacuation of RBCs from the bowl 214, the configuration of skirt 342 preferably allows air from plasma collection bag 216 to easily enter the primary separation chamber 304. That is, the skirt 342 is spaced from the feed tube 316 such that it does not block the flow of air from the effluent tube 320 to the separation chamber 304. Accordingly, air need not cross the wet core 328 in order to allow RBCs to be evacuated. It should be understood that this configuration and arrangement of skirt 342 also facilitates air removal from the separation chamber 304 during bowl filling.

When all of the RBCs from bowl 214 have been moved to the temporary storage bag 212, the system 200 is ready to begin the next plasma collection cycle. In particular, controller 226 again activates the two pumps 232, 234 and the motor 228. In order to "clean" the core 328 prior to the next collection cycle, the controller 226 preferably activates the motor 328 and the pumps 232, 234 in such a manner (or in such a sequence) as to rotate the bowl 214, at its operating speed, for some period of time before anti-coagulated whole blood is allowed to reach the primary separation chamber 304. This rotation of the bowl 214 and core 328 forces the residual blood cells that may have adhered to or been "trapped" in the secondary separation chamber 360 down the chamber 360 and out of the core 328 through the lower core holes 334. Thus, the core 328 is effectively "cleaned" of residual blood cells that might have adhered to its surface during the previous cycle, and the plasma collection process proceeds as described above.

In particular, anti-coagulated whole blood separates into its constituent components within the primary separation chamber 304 of the bowl 214 and plasma is pumped through the core 328. Separated plasma is removed from the bowl 214 and transported along the outlet line 222 to the plasma collection bag 216 adding to the plasma collected during the first cycle. When the primary separation chamber 304 of the bowl 214 is again full of RBCs (as sensed by the optical detector), the controller 226 stops the collection process. Specifically, the controller deactivates the two pumps 232, 234 and the motor 228. If the process is complete (i.e., the desired amount of plasma has been donated), then the system returns the RBCs to the donor. In particular, controller 226 activates pump 232 in the reverse direction to pump RBCs from the bowl 214 and from the temporary storage bag 212 through the inlet line 218. The RBCs flow through the phlebotomy needle 206 and are thus returned to the donor.

After the RBCs have been returned to the donor, the phlebotomy needle 206 may be removed and the donor released. The plasma collection bag 216, which is now full of separated plasma, may be severed from the disposable collection set 202 and sealed. The remaining portions of the disposable set 202, including the needle, bags 210, 212 and bowl 214 may be discarded. The separated plasma may be shipped to a blood bank or hospital or to a fractionation center where the plasma is used to produce various components.

In a preferred embodiment, the system 200 further includes one or more means for detecting whether the core 328 has become clogged. In particular, the blood processing machine 204 may include one or more conventional fluid flow sensors (not shown) coupled to the controller 226 to measure flow of anti-coagulated whole blood into the bowl 214 and the flow of separated plasma out of the bowl 214. Controller 226 preferably monitors the outputs of the flow sensors and if the flow of whole blood exceeds the flow of plasma for an extended period of time, the controller 226 preferably suspends the collection process. The system 200 may further include one or more conventional line sensors (not shown) that detect the presence of red blood cells in the outlet line 222. The presence of red blood cells in the outlet line 222 may indicate that the blood components in the separation chamber 304 have spilled over the skirt 342.

Figure 5:
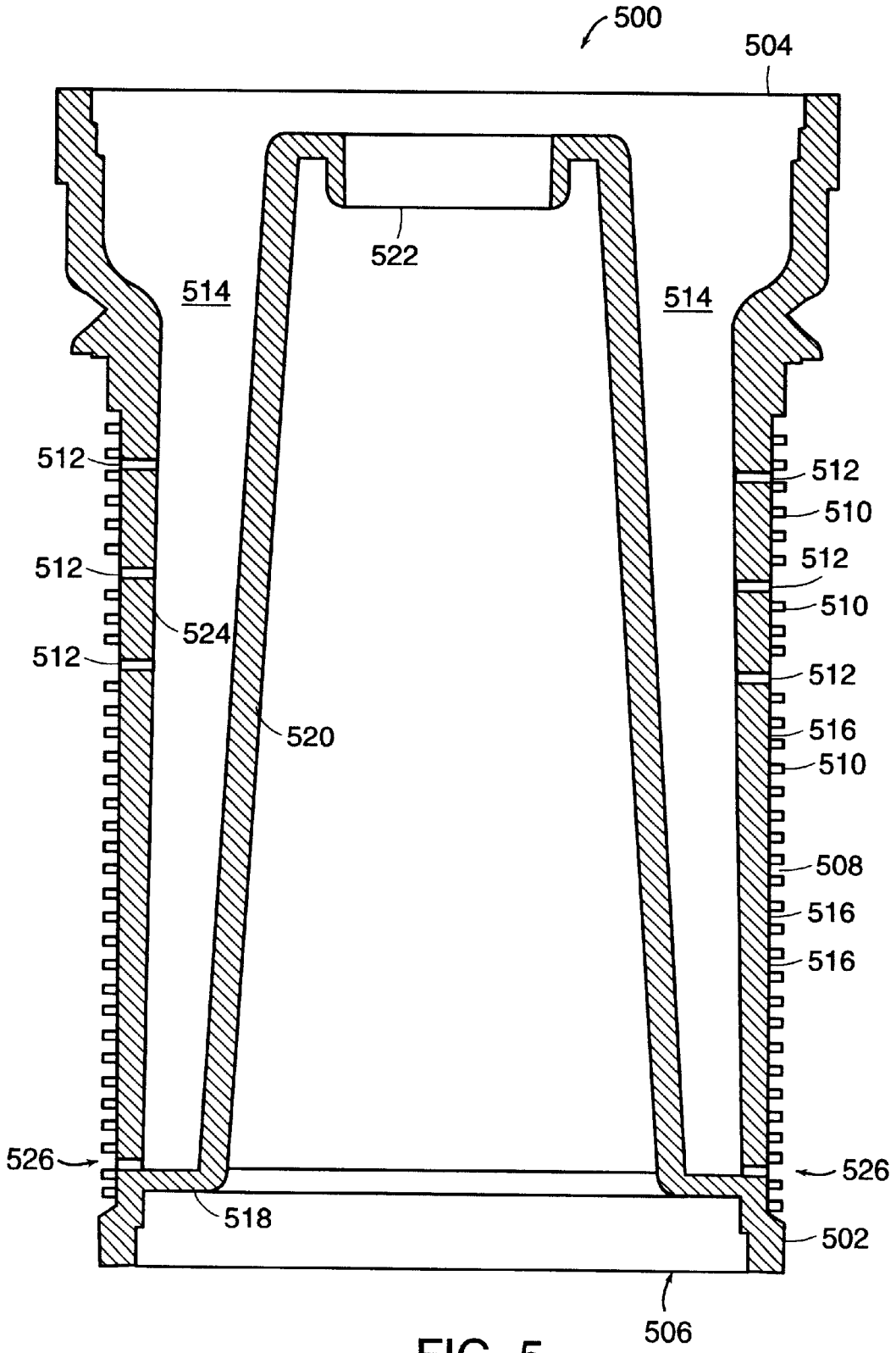
FIGS. 5–7 are side elevation views, taken in section, of alternative configurations of the core of the present invention.
Figure 6:
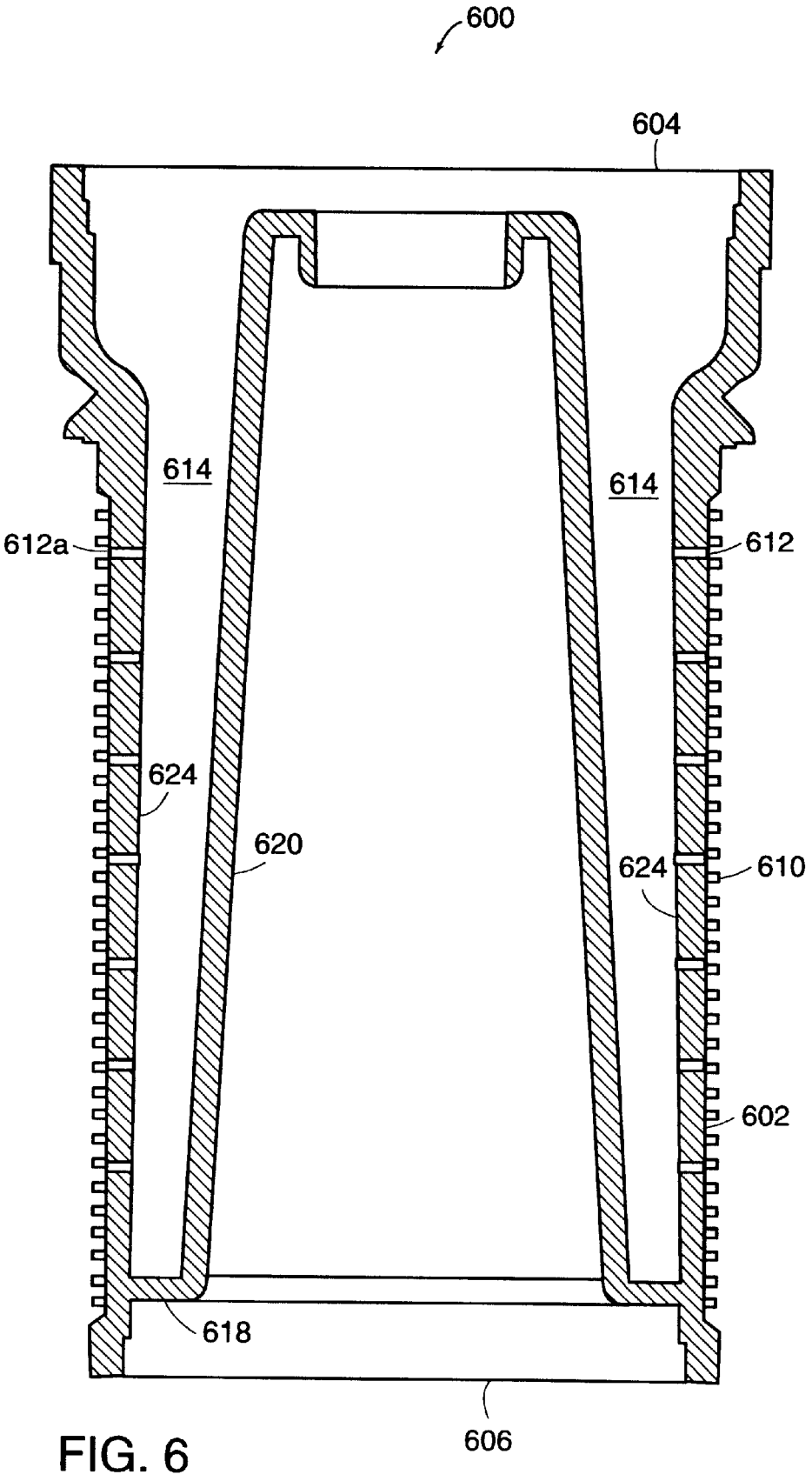
Figure 7:
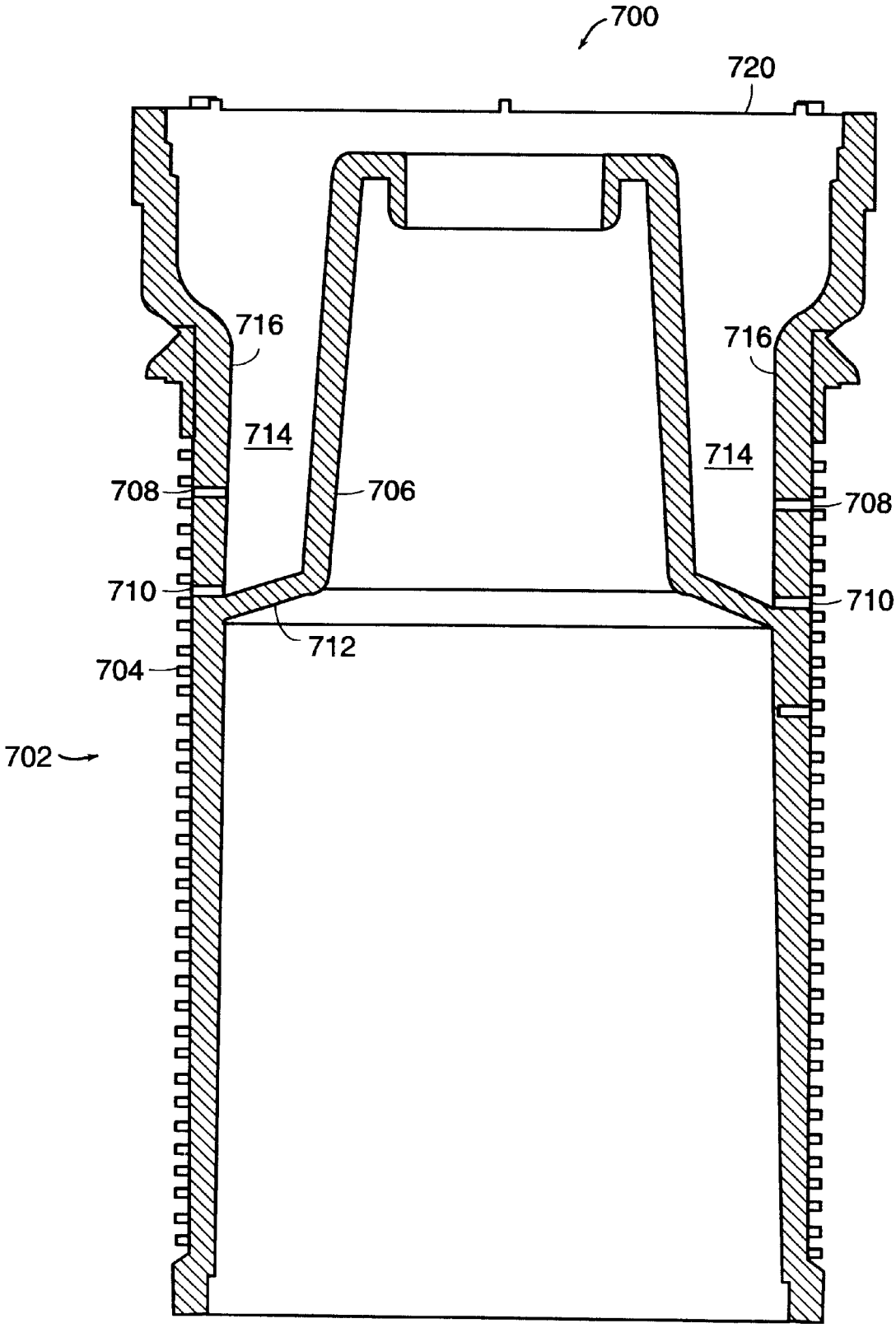

It should be understood that the core of the present invention may have alternative configurations. FIGS. 5–7 illustrate various alternative configurations.

FIG. 5, for example, is a cross-sectional side view of one alternative core 500 configuration. In this embodiment, the core 500 has a generally cylindrical shape defining an outer wall 502, a first or upper open end 504 and a second or lower open end 506. The outer wall 502 includes three pairs of opposing upper core holes 512 and a pair of opposing lower core holes 526 that provide fluid communication through the outer wall 502 like the embodiment of FIG. 3. The core 500 further includes an inner wall 520 and a skirt 518 disposed between the inner wall 520 and an inner surface 524 of the outer wall 502. In this embodiment, the inner wall 520, the skirt 518, and the inner surface 524 of the outer wall 502 cooperate to define a secondary separation chamber 514.

The outer wall 502 also has an outer surface 508. Formed on the outer surface 508 are a plurality of spaced-apart ribs 510. That is, ribs 510 may extend circumferentially around all or a portion of the outer surface 508 of the wall 502. The spaces between adjacent ribs 510 preferably define corresponding channels 516 that lead to the holes 512, 526.

FIG. 6 is a cross-section side view of a variation of the core configuration of FIG. 5. The core 600 of this embodiment similarly includes an outer wall 602, an inner wall 620 and a skirt 618 disposed between the inner wall 620 and an inner surface 624 of the outer wall 602. The inner wall 620, the skirt 618, and the inner surface 624 of the outer wall 602 cooperate to define a secondary separation chamber 614. In this embodiment, the core 600 also includes a plurality of ribs 610 and a plurality of core holes 612 that are disposed along a substantial axial length of the outer wall 602 of the core 600. That is, rather than providing one or more upper core holes and one or lower core holes, there are a series of core holes 612 relatively evenly distributed along the axial length of the core 600. Nonetheless, the upper most core hole, e.g., hole 612*a*, is still spaced apart from an upper or first opening 620 of the core 600 in a like manner as described above.

FIG. 7 is a cross-sectional side view of a variation of the core configuration of FIG. 5. In this embodiment, the core 700 includes an outer wall 702, an inner wall 706 and a skirt 712 disposed between the inner wall 706 and an inner surface 716 of the outer wall 702. The inner wall 706, the skirt 712, and the inner surface 716 of the outer wall 702 cooperate to define a secondary separation chamber 714. A pair of lower core holes 710 preferably extend through the outer wall 702 of the core 700 proximate the skirt 712. A pair of upper core holes 708 preferably extend through the outer wall 702 in spaced-apart relation relative to a first open end 720. As shown, the skirt 712 is positioned relatively high in the core 700. The truncated cone formed by inner wall 706 is thus disposed in approximately the upper third or half of the core 700, as opposed to extending a substantial axial length of the core as in other embodiments.

Figure 8:
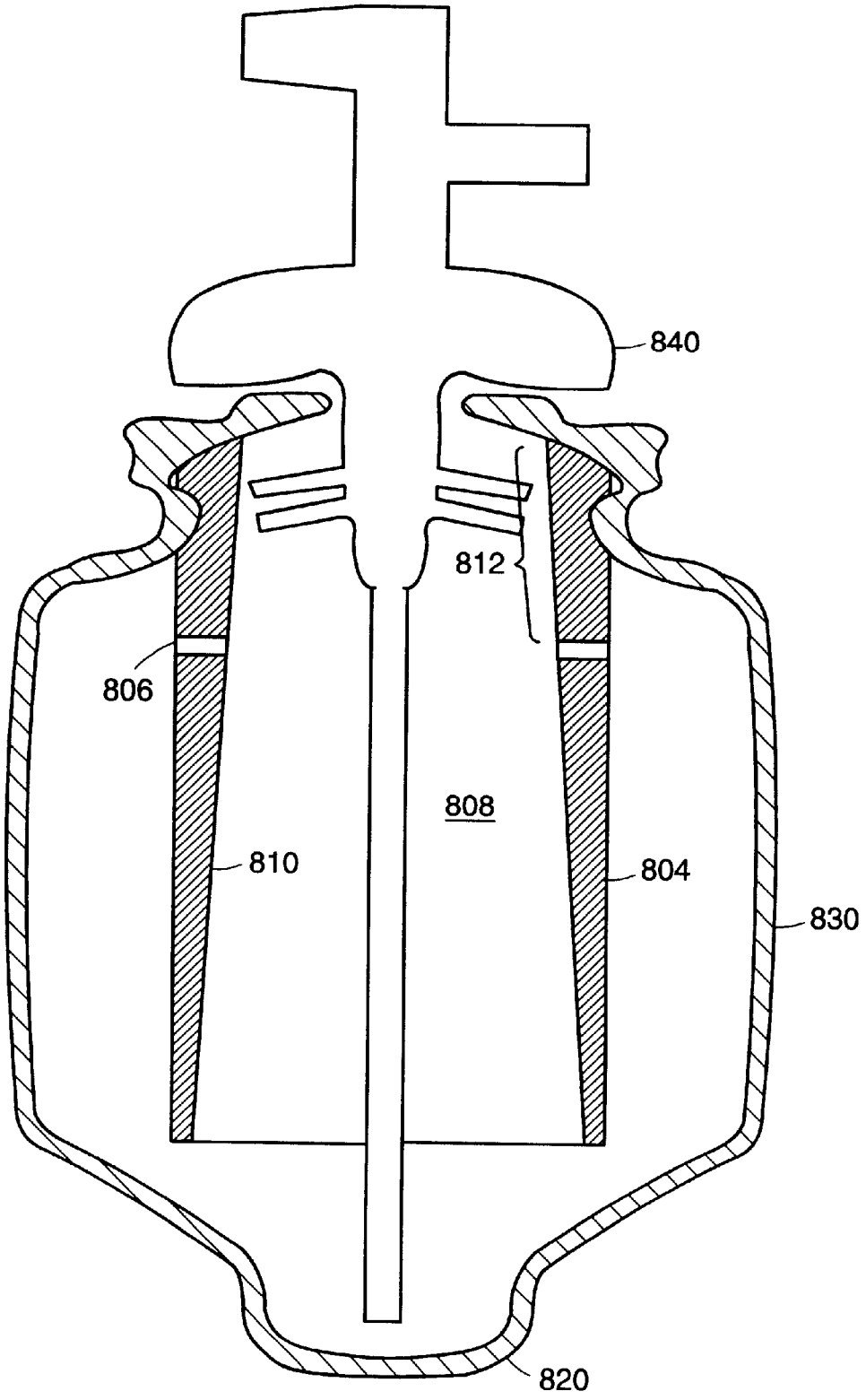
FIG. 8 is a side elevation view, taken in section, of a second alternative configuration of the core of the present invention.
Figure 9:
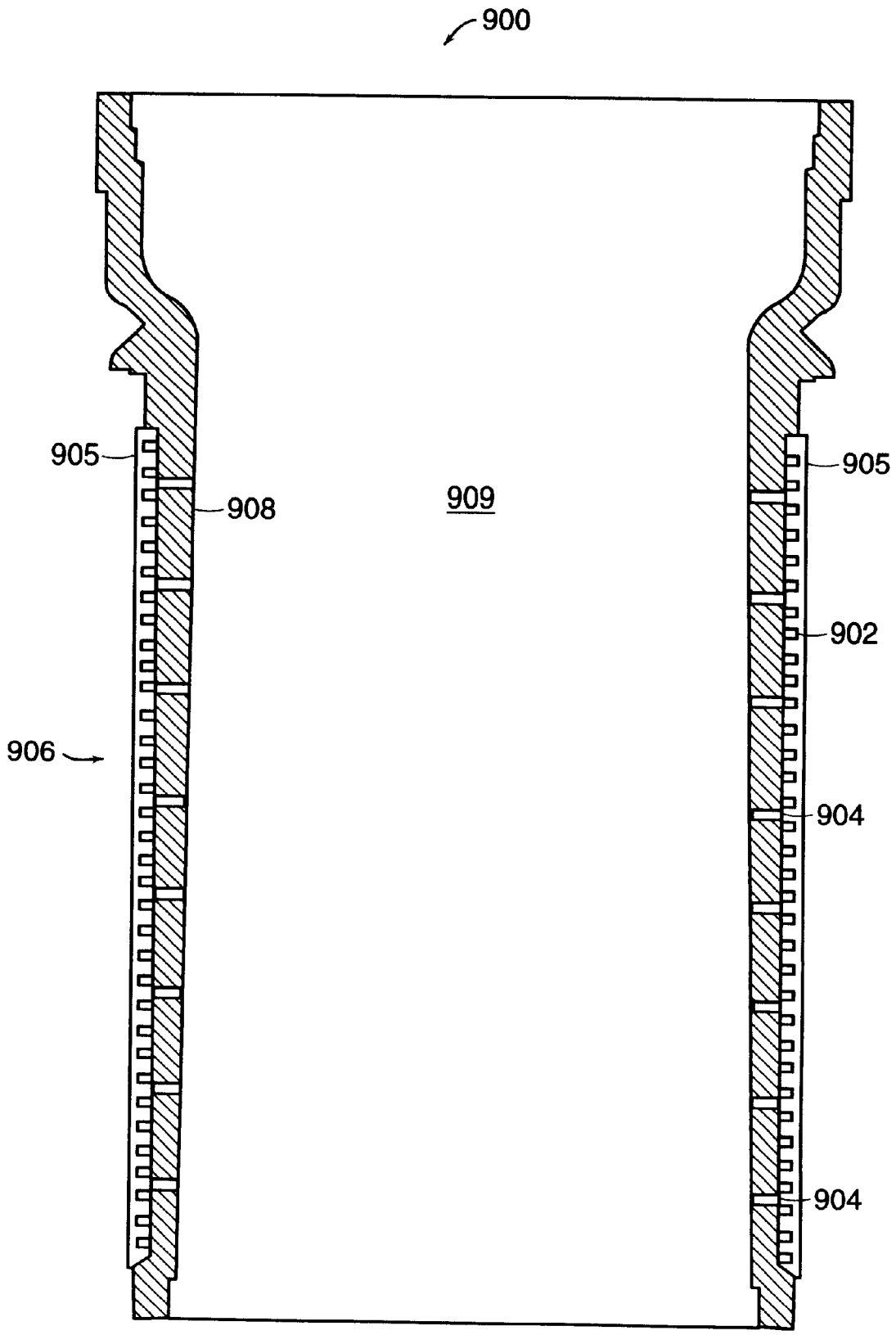
FIGS. 9 and 10 are side elevation views, taken in section, of variations of the core shown in FIG. 8.
Figure 10:
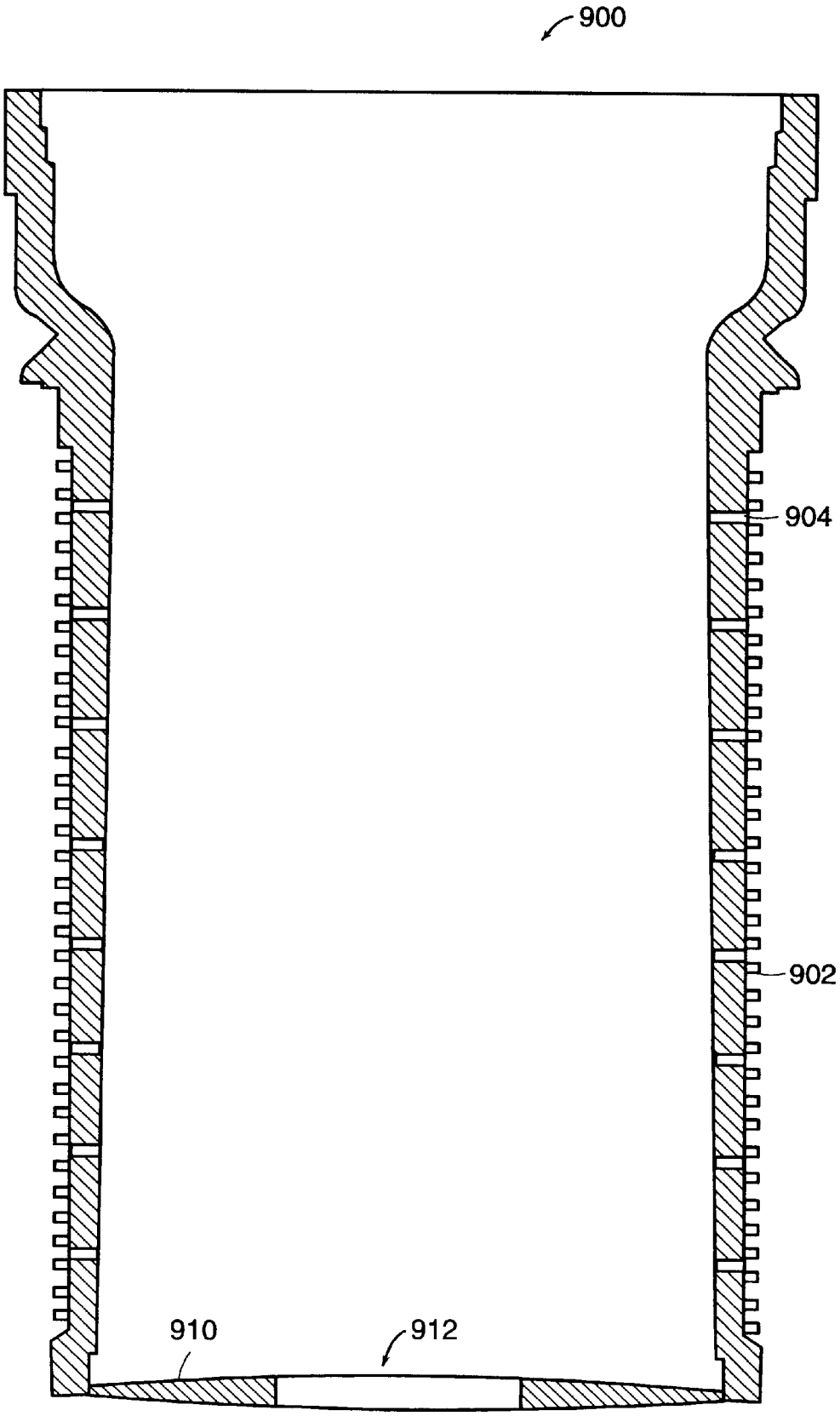

FIGS. 8–10 illustrate still further core configurations. FIG. 8 is a cross-sectional side view of a core 800 and bowl 830. More particularly, the core 800 includes an outer wall 804 defining an inner surface 810. A pair of upper core holes 806 are disposed on the core 800 adjacent to a sealed region 812. The inner surface 810 of the outer wall 804 is sloped away from the header assembly 840. In operation, plasma passes through the second series of openings 806 in the manner described above. Once within the secondary separation chamber 808, the plasma is further separated to form a "purer" plasma layer by continued rotation of the bowl 830 and core 800. The slope of inner surface 810, moreover, causes residual cells to move downwardly along the outer wall 804 and out through the lower core holes 802, in a manner similar to that described above. As shown, core 800 does not include an inner wall.

It should be understood that only a single passageway 806 may be formed in the core 804.

FIG. 9 is a cross-sectional side view of a variation of the core configuration of FIG. 8. In this embodiment, the core 900 includes an outer wall 906 having an inner surface 908 which defines a secondary separation chamber 909. A plurality of ribs 902 may be disposed around the outer wall 906 of the core 900. As in the embodiment of FIG. 6, there are a series of core holes 904 relatively evenly distributed along the axial length of the core 900.

FIG. 10 is a cross-sectional side view of yet another variation of the core configuration of FIG. 9 in which the core 900 includes a skirt 910 which defines a skirt through-opening 912. In this embodiment, the core 900 does not include an inner wall. The skirt through opening 912, moreover, is designed, e.g., sized, to receive the feed tube from the header assembly. It is also sized to prevent whole blood from splashing back inside the core.

Those skilled in the art will understand that still other configurations of the core, are possible provided that the plasma is forced to pass through the core before reaching the outlet. For example, they will recognize that a filter medium may be wrapped around or otherwise disposed about the outer wall of the core. They will recognize, alternatively, that the filter medium may be integrated or incorporated into the core structure. Those core embodiments having ribs are especially suited to the addition of a filter medium or membrane. The filter medium could also be disposed within the core to filter the blood component that enters into the secondary separation chamber.

Those skilled in the art will understand that still other configurations of the core, are possible provided that the plasma is forced to pass through the core before reaching the outlet. For example, they will recognize that a filter medium may be wrapped around or otherwise disposed about the outer wall of the core. They will recognize, alternatively, that the filter medium may be integrated or incorporated into the core structure. Those core embodiments having ribs are especially suited to the addition of a filter medium or membrane 905 (FIG. 9). The filter medium could also be disposed within the core to filter the blood component that enters into the secondary separation chamber.

The foregoing description has been directed to specific embodiments of this invention. It will be apparent, however, that other variations and modifications may be made to the described embodiments with the attainment of some or all of their advantages. Accordingly, this description should be taken only by way of example and not by way of limitation. It is the object of the appended claims to cover all such variations and modifications as come within the true spirit and scope of the invention.

What is claimed is:

1. A blood processing centrifugation bowl for separating whole blood into fractions, the bowl comprising:

a bowl body rotatable about an axis, the bowl body having an open end and a base and defining a primary separation chamber;

a header assembly received in the open end of the bowl body;

an outlet disposed within the bowl body for extracting one or more blood fractions from the bowl; and a core disposed within the bowl body, the core defining a secondary separation chamber therein, the core including an outer wall at least part of which is outboard of the outlet relative to the axis of rotation, the outer wall having a sealed region disposed at an upper portion of the core relative to the header assembly and a fluid transfer region adjacent to the sealed region, and at least one core passageway extends through the outer wall within the fluid transfer region to provide fluid communication between the primary separation chamber and the outlet, the outer wall further including an inner surface adjacent the secondary separation chamber and facing the axis of rotation, the inner surface including a slope that moving away from the outlet moves away from the axis of the rotation so as to cause more dense fractions of whole blood to move away from the outlet when the bowl body is rotating.

2. The blood processing centrifugation bowl of claim 1 wherein the sealed region is free of perforations, passageways and holes.

3. The blood processing centrifugation bowl of claim 2 wherein the core has an useful axial length that extends into the primary separation chamber, the sealed region has an axial length and the length of the sealed region is approximately 15 percent or more of the useful length of the core.

4. The blood processing centrifugation bowl of claim 3 wherein the at least one core passageway is adjacent to the sealed region.

5. The blood processing centrifugation bowl of claim 3 having a plurality of core passageways formed in the fluid transfer region of the core.

6. The blood processing centrifugation bowl of claim 5 wherein at least some of the core passageways are adjacent to the sealed region.

7. The blood processing centrifugation bowl of claim 6 wherein the outer wall includes at least two upper core holes formed on an upper portion of the outer wall.

8. The blood processing centrifugation bowl of claim 5 wherein the core further includes an inner wall relative to the axis of rotation, the inner wall joined to the outer wall, extending axially with the outer wall, and being free from any perforation, holes or passageways.

9. The blood processing centrifugation bowl of claim 8 wherein the inner wall is generally cylindrically shaped having first and second open ends.

10. The blood processing centrifugation bowl of claim 9 wherein the core further includes at least one core passageway disposed adjacent to the point at which the inner wall joins the outer wall.

11. The blood processing centrifugation bowl of claim 2, wherein the core has an useful axial length that extends into the primary separation chamber, the sealed region has an axial length and the length of the sealed region is approximately 15 to 60 percent of the useful length of the core.

12. The blood processing centrifugation bowl of claim 2, wherein the core has an useful axial length that extends into the primary separation chamber, the sealed region has an axial length and the length of the sealed region is approximately 25 to 33 percent of the useful length of the core.

13. The blood processing centrifugation bowl of claim 1, wherein the slope of the inner surface of the outer wall defines an angle a relative to the axis of rotation that is in the range of approximately +10 to −10 degrees.

14. The blood processing centrifugation bowl of claim 13 wherein the slope angle $\alpha$ is approximately 1 degree.

15. The blood processing claim centrifugation bowl of claim 1 wherein the core is mounted to the bowl body for rotation therewith.

16. The blood processing centrifugation bowl of claim 15 wherein the outlet is an effluent tube that includes an entryway, and at least a portion of the core is located outboard of the entryway relative to the axis of rotation.

17. The blood processing centrifugation bowl of claim 16 wherein the outer wall of the core is coaxially aligned about and disposed outboard of the entryway to the effluent tube relative to the axis of rotation.

18. The blood processing centrifugation bowl of claim 1 wherein the core further includes an optical reflector.

19. The blood processing centrifugation bowl of claim 1 wherein the core further comprises at least one rib disposed about the outer wall.

20. The blood processing centrifugation bowl of claim 19 further comprising a filter media wrapped around the outer surface of the outer wall over the at least one rib.

21. A method for extracting one or more blood fractions from whole blood, the method comprising the steps of:

providing a blood processing centrifugation bowl having a bowl body rotatable about an axis, the bowl body defining a generally enclosed primary separation chamber having an open end, a header assembly received in the open end of the bowl body, an outlet disposed within the bowl body and a core disposed within the bowl body and defining a secondary separation chamber therein, the core including an outer wall at least part of which is outboard of the outlet relative to the axis of rotation, the outer wall having a sealed region disposed at an upper portion of the core relative to the header assembly, a fluid transfer region adjacent to the sealed region, and at least one core passageway extending through the outer wail within the fluid transfer region rotating the blood processing centrifugation bowl;

supplying whole blood to the rotating centrifugation bowl;

separating the whole blood into fractions, including a less dense fraction, within the primary separation chamber;

forcing the less dense blood fraction through the rotating core and into the secondary separation chamber along with at least some residual cells;

further separating the less dense blood fraction from the residual cells within the secondary separation chamber to produce a purer less dense blood fraction; and extracting the purer less dense blood fraction from the blood processing centrifugation bowl.

22. The method of claim 21 wherein the sealed region of the blood processing centrifugation bowl is free of perforations, passageways and holes.

23. The method of claim 22 wherein the core has an overall axial length, the sealed region has an axial length and the length of the sealed region is approximately 25 percent or more of the overall length of the core.

24. The method of claim 23 wherein the core has an overall axial length, the sealed region has an axial length and the length of the sealed region is approximately 25 to 60 percent of the overall length of the core.

25. The method of claim 24 further comprising the step of stopping the extraction of the purer less dense blood fraction from the blood processing centrifugation bowl in response to optically detecting a more dense blood fraction reaching the core.

* * * * *

UNITED STATES PATENT AND TRADEMARK OFFICE

CERTIFICATE OF CORRECTION

PATENT NO. : 6,629,919 B2
DATED : October 7, 2003
INVENTOR(S) : Yair Egozy et al.

It is certified that error appears in the above-identified patent and that said Letters Patent is hereby corrected as shown below:

Column 13,
Line 66, change “angle a” to -- angle α --

Column 14,
Line 1, change “processing claim centrifugation” to -- processing centrifugation --
Line 35, change “outer wail” to -- outer wall --

Signed and Sealed this

Thirteenth Day of April, 2004

JON W. DUDAS
*Acting Director of the United States Patent and Trademark Office*